United States Patent [19]

Ducros et al.

[11] 4,271,984

[45] Jun. 9, 1981

[54] DEVICE FOR DISPENSING TWO PASTY SUBSTANCES IN ADJUSTABLE PROPORTIONS

[75] Inventors: Luc Ducros; Roger Navarro, both of Castres, France

[73] Assignee: Pierre Fabre S.A., Paris, France

[21] Appl. No.: 27,731

[22] Filed: Apr. 6, 1979

[30] Foreign Application Priority Data

Apr. 6, 1978 [FR] France ..... 78 10246

[51] Int. Cl.[3] ..... B65D 35/22

[52] U.S. Cl. ..... 222/94; 222/144.5; 222/484; 222/488; 222/536

[58] Field of Search ..... 222/94, 129, 134, 142.7, 222/142.9, 145, 481, 482, 484, 485, 486, 488, 506, 528, 529, 531, 533, 536, 537, 144.5

[56] References Cited

U.S. PATENT DOCUMENTS

| | | | |
|---|---|---|---|
| 2,205,147 | 6/1940 | Madsen | 222/488 |
| 2,919,724 | 1/1960 | Anderson | 222/145 |
| 3,416,707 | 12/1968 | Pollard | 222/94 |
| 4,164,305 | 8/1979 | Haggerty | 222/536 |

FOREIGN PATENT DOCUMENTS

| | | |
|---|---|---|
| 2054783 | 5/1971 | France . |
| 2137882 | 12/1976 | France . |

*Primary Examiner*—H. Grant Skaggs
*Attorney, Agent, or Firm*—Alan H. Levine

[57] ABSTRACT

A dispensing device for dispensing two pasty substances in adjustable proportions from a deformable tube containing those substances in different regions within the tube. The device includes a body having two passages terminating in two outlets in the body, and a valve member pivotable within the body and having at least one through passage extending between an inlet on the surface of the valve member and a common outlet nozzle. The valve member has two extreme positions in which both passages in the body are fully closed or fully open, respectively. Pivotal positions of the valve member between these two extremes determine the degree of alignment of the inlet in the valve member with at least one of the outlets, so that the amount of substance dispensed through the partially covered outlet can be varied while the amount of substance dispensed through the other outlet remains constant.

9 Claims, 12 Drawing Figures

DEVICE FOR DISPENSING TWO PASTY SUBSTANCES IN ADJUSTABLE PROPORTIONS

The present invention relates to a device for dispensing pasty substances.

It relates more particularly to a device for dispensing, in adjustable proportions, two pasty substances contained separately in a deformable tube provided with an outlet.

The term "pasty substance" designates, in the sense of its present use, pastes, creams, gels and other substances of the same type usually contained in deformable tubes.

Certain applications exist where it is desirable to be able to dispense, in adjustable proportions, two pasty substances contained separately in a deformable tube.

This is the case for example of sun products which, apart from a pasty excipient, such as a cream, also contain an active pasty substance acting a solar filter of which the proportion must be modified with respect to the excipient as a function of the conditions of use of the product.

Devices have already been proposed for dispensing, in adjustable proportions, two pasty substances contained in a deformable tube. The main drawback of these prior devices is that they have a complex structure, this involving high manufacturing costs for products intended to be discarded after use, and more or less considerable modification is often necessary of the outlet of the tube on which they are intended to be mounted.

It is an object of the present invention to avoid such drawbacks by proposing a device of the above-mentioned type which is of simple construction and which does not necessitate any modification of the outlet of the tube on which it is intended to be mounted.

More particularly, the present invention relates to a device for dispensing, in adjustable proportions, two pasty substances contained separately in a deformable tube provided with an outlet, which is characterised in that it comprises a terminal element adaptable on the outlet of the tube to define two chambers inside the tube adapted to contain the two pasty substances and two corresponding outlets opening out on an outlet surface of the terminal element; a dispenser mounted to pivot on the terminal element about an axis perpendicular to the axis of the outlet of the tube between two extreme positions between which a cylindrical surface of the dispenser sweeps the outlet surface of the terminal element, the dispenser having one or two through passages opening through an inlet section in the cylindrical surface of the dispenser and one end terminating in a common outlet nozzle, the inlet section or sections more or less uncovering the two outlets of the outlet surface of the terminal element as a function of the position of pivoting of the dispenser.

In a particularly advantageous embodiment of the invention, the terminal element comprises a pipe plunging inside the tube of which the bottom end arrives at a determined height with respect to the bottom of the tube and of which the top end opens out on one of the outlets of the outlet surface of the terminal element, and a passage adjacent the pipe of which the bottom end communicates with a peripheral chamber about the pipe and of which the top end opens into the other outlet of the outlet surface of the terminal element, this tube being filled with a first pasty substance from the bottom of the tube up to the level of the bottom end of the pipe and with a second pasty substance in the peripheral chamber.

The dispenser of the device of the invention advantageously comprises a cylinder in which the through passage or passages are made substantially radially and extend in a nozzle projecting radially with respect to the cylinder.

In a first embodiment of the invention, the two outlets of the outlet surface of the terminal element are disposed adjacently in a direction substantially parallel to the axis of rotation of the dispenser and the dispenser then comprises two through passages of which the inlet sections are disposed adjacently in a direction substantially parallel to the axis of rotation of the dispenser.

In this first embodiment, one of the outlets of the terminal element has a larger opening that the other to allow it to be in communication with the corresponding inlet section of the dispenser over a range of positions of the dispenser for which the other inlet section more or less uncovers the corresponding outlet.

In a second embodiment of the invention, the two outlets of the outlet surface of the terminal element are disposed adjacently in a direction substantially at right angles with respect to the axis of rotation of the dispenser and the dispenser comprises one through passage only.

In this second embodiment of the invention, the inlet section of the through passage of the dispenser has a sufficient opening to allow it to uncover the two outlets of the surface of the terminal element simultaneously.

Other characteristics and advantages of the invention will be more readily understood on reading the following description of two embodiments of the invention, and with reference to the accompanying drawings, in which.

Reference will now be made to FIGS. 1 to 9 illustrating a device according to the first embodiment of the invention.

Figure 1:
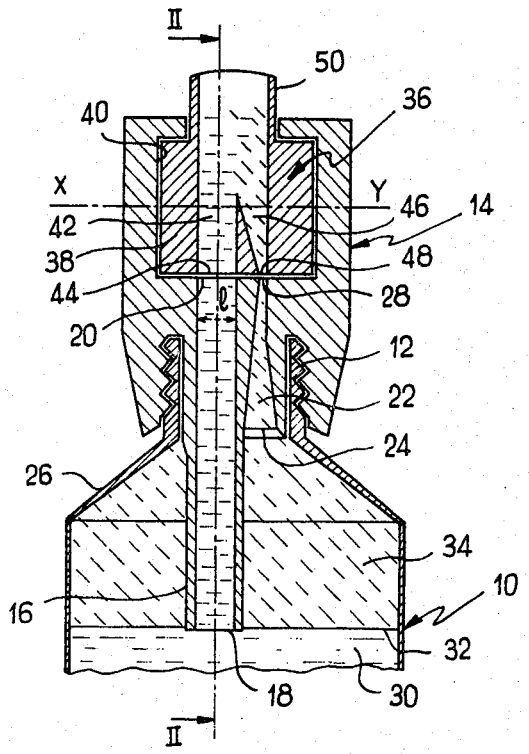
FIG. 1 is a view in section, along a plane passing through the axis of rotation of the dispenser, of a device of the invention according to the first embodiment mentioned above, in which the dispenser comprises two through passages.
Figure 2:
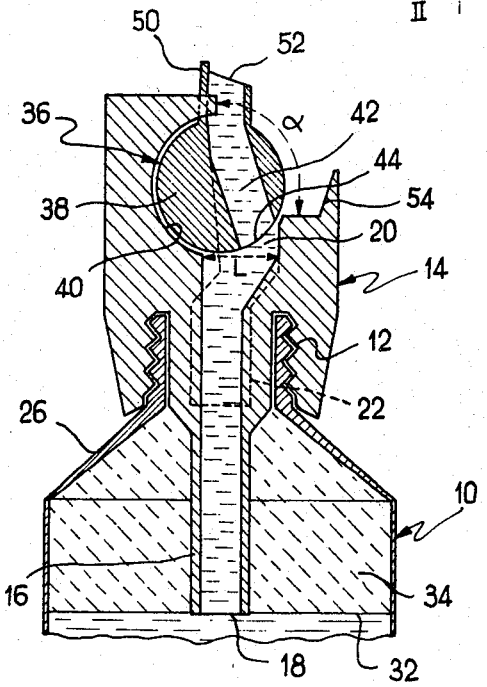
FIG. 2 is a view in section taken along line II—II of FIG. 1.
Figure 3:
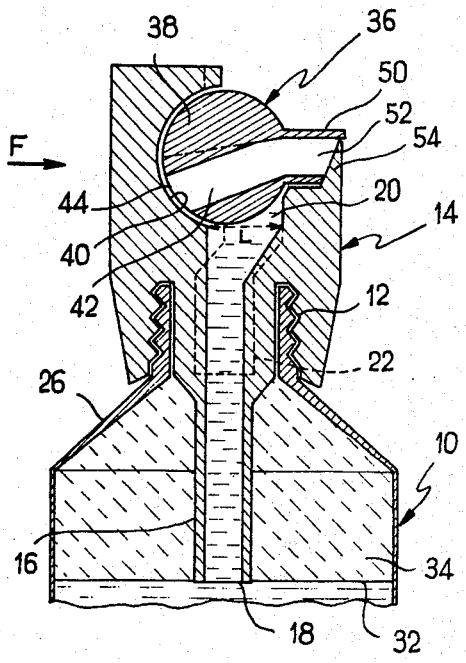
FIG. 3 is a view similar to that of FIG. 2, in which the dispenser is in closed position.

The device shown in FIGS. 1 to 3 comprises a deformable tube 10, made for example of a metallic material or a plastics material and provided with an externally threaded outlet 12. On the threaded outlet 12 of the tube 10 is screwed a terminal element or body 14 of generally cylindrical external form. The terminal element 14 comprises a pipe 16 plunging inside the tube, of which the bottom end 18 arrives at a determined height with respect to the bottom of the tube (not shown) and of which the top end opens on an outlet 20 of an outlet surface of the terminal element 14 which presents a cylindrical profile of axis XY (cf. FIG. 1), this axis XY being in the plane of FIG. 1 and perpendicular to the plane of FIGS. 2 and 3.

The nozzle 16 presents a circular internal section which, at a short distance below the outlet 20, begins to widen to constitute an outlet of oblong shape of which the length L corresponds substantially to double the internal diameter of the nozzle 16 and of which the width 1 corresponds to the internal diameter of the nozzle 16 (cf. FIGS. 1 to 4).

Figure 4:
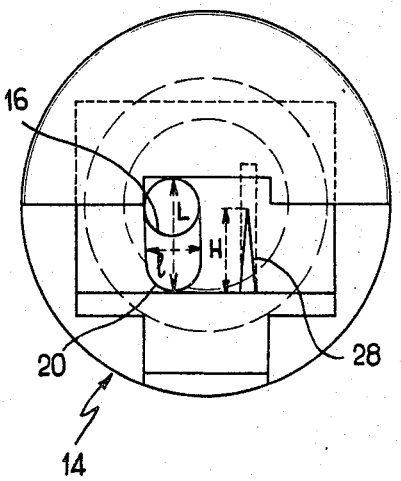
FIG. 4 is a plan view of the terminal element of the device of FIGS. 1 to 3, in which the dispenser has been removed.
Figure 5:
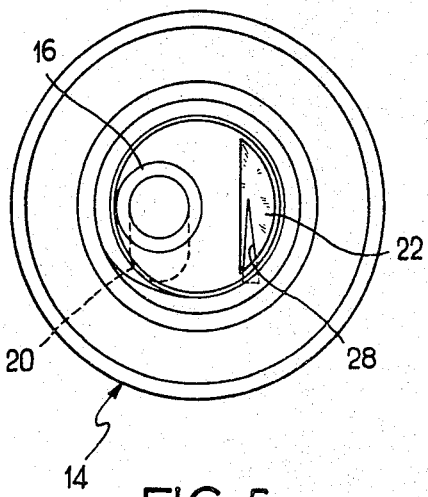
FIG. 5 is a view from underneath of the terminal element of FIG. 4.
Figure 6:
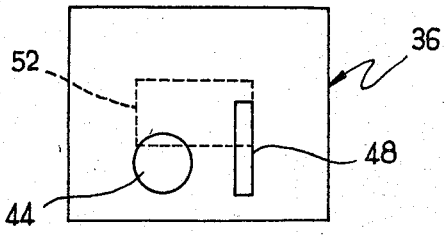
FIG. 6 is a rear view of the dispenser in the direction of arrow F of FIG. 3.

The terminal element 14 further comprises an inner passage 22 adjacent the pipe 16, of which the bottom end 24 arrives at the level of the top end of the truncated part 26 of the tube 10 which connects the body of the tube to the outlet 12. The top end of the passage 22 opens into another outlet 28, adjacent the outlet 20, of the outlet surface of the terminal element 14. The passage 22 narrows upwardly and the outlet 28 takes an elongated triangular form of which the large height H is parallel to the largest length of the outlet 20 (FIG. 4). In FIG. 4, the height H of the outlet 28 corresponds substantially to $\frac{3}{4}$ of the length L of the outlet 20.

The tube 10 contains a first pasty substance 30 filling the tube 10 from the bottom to level 32 of the bottom end 18 of the pipe 16. The tube 10 further contains a second pasty substance 34 filling the peripheral chamber defined inside the tube 10 around the pipe 16, above level 32.

When a pressure is exerted on the deformable tube 10, the first pasty substance 30 tends to be extruded from the tube via the pipe 16, whilst the second pasty substance 34 tends to be extruded simultaneously from the tube via passage 22.

The proportion of the mixture of the pasty substances 30 and 34 is obtained by a dispenser or valve member 36 comprising a cylinder 38 mounted to pivot inside a housing 40 made in the terminal element 14 around the axis XY mentioned above and of which the inner cylindrical wall comprises the outlet surface of the terminal element.

The dispenser 36 may pivot through about a quarter turn between two extreme positions shown respectively in FIGS. 2 and 3. To this end, the terminal element 14 has material removed therefrom over a sector of angle $\alpha$ of about 90° (Cf. FIG. 2). In the position of FIGS. 1 and 2, the dispenser is in fully opened position whilst in the position of FIG. 3, it is in closed position, Between these two extreme positions, a cylindrical surface of the cylinder 38 of the dispenser 36 sweeps the outlet surface of said terminal element ensuring a tight contact between the dispenser and the mouthpiece.

The dispenser 36 comprises a through passage 42 opening via an inlet section 44 in the cylindrical surface mentioned above of the dispenser. The through passage 42 and the inlet section 44 present a circular section equal to the circular inner section of the pipe 16. The dispenser 36 further comprises another through passage 46 opening via an inlet section 48 adjacent the inlet section 44. The inlet section 48 presents a rectangular inner shape (cf. FIG. 6) and the through passage 46 widens progressively to join the through passage 42 and form a single channel terminating in a common outlet nozzle 50. This nozzle 50 is directed radially with respect to the axis of pivoting XY of the dispenser 36 and presents an opening 52 of rectangular inner section (cf. FIG. 6).

The inlet sections 44 and 48 of the through passages 42 and 46 of the dispenser 36 are adapted to cooperate respectively with the outlets 20 and 28 of the mouthpiece 14.

In closed position (cf. FIG. 3), the dispenser 36 is oriented with its nozzle 50 substantially perpendicular to the axis of the orifice 12, the opening 52 of the nozzle 50 being obturated by an extension 54 of the terminal element 14. In this position, the outlets 20 and 28 of the terminal element are totally obturated by the cylinder 38 of the dispenser 36.

Figure 7:
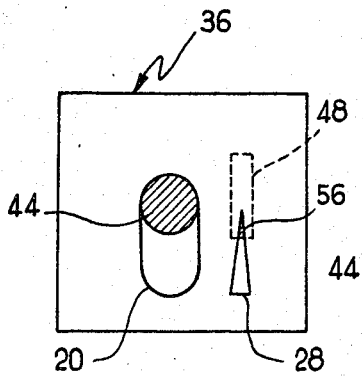
FIGS. 7 to 9 illustrate different relative positions of the dispenser and the terminal element.

By progressively pivoting the dispenser 36 about the axis XY, the dispenser arrives in a position corresponding to that of FIG. 7 where the inlet section 44 of the through passage 42 is completely supplied by the outlet 20 of the pipe 16 and where the inlet section 48 of the through passage 46 intersects a triangular portion 56 (shown hatched) of the outlet 28. It will be noted that the proportion of pasty substance 34 extruded with respect to the pasty substance 30 extruded is a function of the circular section 44 and that, in the case of FIG. 7, the proportion of pasty substance 34 extrudes is small with respect to the quantity of pasty substance 30 extruded.

Figure 8:
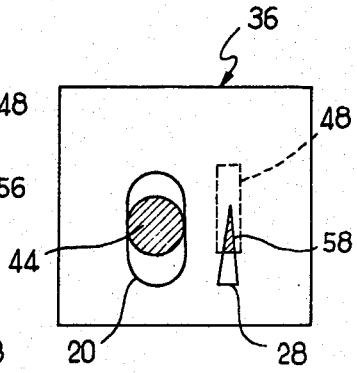

By pivoting the dispenser 36 a little more, it arrives in the position of FIG. 8 in which the inlet section 44 is substantially opposite the central part of the opening 20, whilst the inlet section 48 uncovers a triangular part 58 of the outlet orifice 28. This triangular part 58, shown hatched, presents a section greater than the triangular part 56 of FIG. 7 and consequently the proportion of pasty substance 34 extruded with respect to the pasty substance 30 extruded is greater than in the case of FIG. 7.

Figure 9:
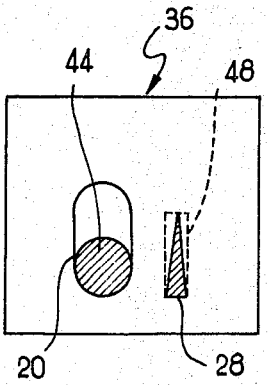

By pivoting the dispenser 36 even further, it reaches the fully open position shown in FIG. 2 in which the relative position of the outlets of the terminal element and the inlet sections of the dispenser are shown schematically in FIG. 9. In FIG. 9, the inlet section 44 is still totally supplied by the outlet 20 of the terminal element 14 and the inlet section 48 completely uncovers the triangular outlet 28. This position therefore corresponds to the full flow position of the pasty substance 30 and full flow position of the pasty substance 34.

It will be noted that, of course, the dispenser 36 allows all positions of intermediate adjustment, these positions possibly being marked by a suitable index made on the terminal element 14.

Figure 10:
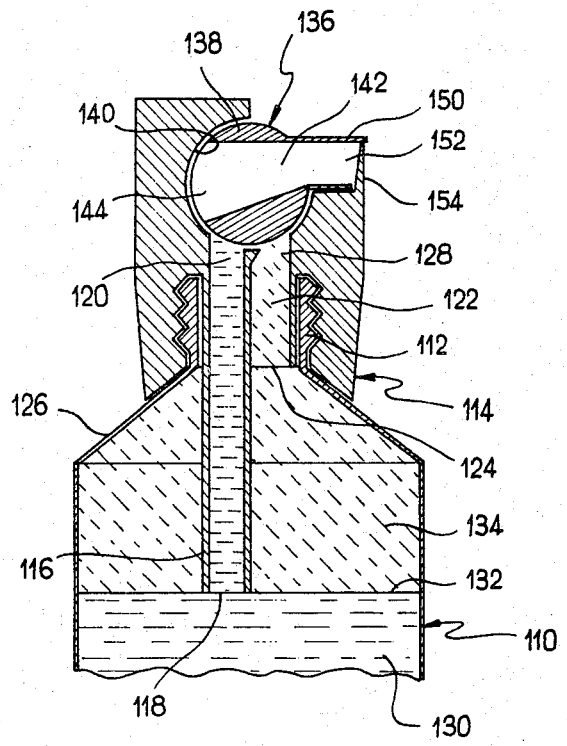
FIG. 10 is a partial view in section, taken along a plane perpendicular to the axis of rotation of the dispenser, of a device according to the second embodiment of the invention, in which the dispenser comprises only one through passage.
Figure 11:
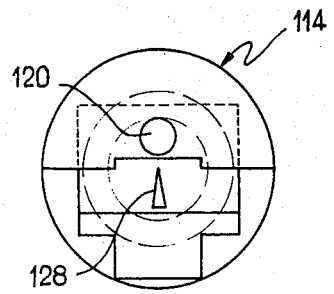
FIG. 11 shows a plan view of the terminal element of the device of FIG. 10, in which the dispenser has been removed.
Figure 12:
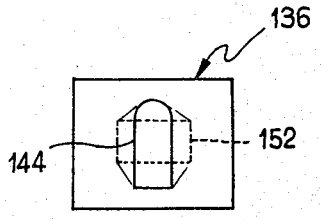
FIG. 12 is a rear view of the dispenser of the device of FIG. 10.

The device according to the second embodiment of the invention, as shown in FIGS. 10 to 12, takes up the essential elements of the device previously described with reference to FIGS. 1 to 9 and the corresponding elements will be designated by the corresponding numerical references increased by 100 units.

The main difference reside in the fact that the outlet 120 presents a circular section corresponding to the circular section of the pipe 116 and that this outlet 120 is aligned with the outlet 128 of triangular section in a direction at right angles with respect to the axis of rotation of the dispenser 136 (cf. FIG. 11). In addition, the dispenser 136 comprises a single through passage 142 of which the inlet section 144 presents an oblong form (cf. FIG. 12) and of which the opening 152 of the nozzle 150 presents a rectangular inner section. The length of the inlet section 144 is such that, when the dispenser 136 is in fully open position, i.e. with the nozzle 150 directed upwardly in line with the outlet orifice 112, it allows both outlets 120 and 128 to open out in the inlet section 144.

Of course, all intermediate positions are possible from a position where only the outlet 120 opens into its inlet section 144 and where, consequently, only the pasty substance 130 is extruded, up to the fully open position where the two pasty substances are extruded simultaneously with the maximum proportion of pasty substance 134 with respect to the pasty substance 130.

Although the invention has been described with reference to preferred embodiments, it will be understood that certain variants of detail may be made thereto without departing from the scope of the invention.

The device of the invention may be provided with a protective cap adapted to cover the top part of the terminal element as well as the dispenser.

The terminal element, dispenser and cap may advantageously be made of a plastics material, the dispenser being force-fitted in the housing of the terminal element.

The device of the invention may be used in all cases where it is desired to dispense, in adjustable proportions, two pasty substances contained in a deformable tube which comprises an outlet.

We claim:

1. For use with a deformable tube containing two pasty substances in two different regions within the tube, a device for dispensing the two pasty substances in adjustable proportions, the device comprising:

a body for mounting on the tube, the body having two passages communicating respectively with the two regions with the tube, each passage terminating in an outlet located in a surface of the body, a valve member mounted for pivotal movement with respect to the body about an axis perpendicular to the direction of flow of the substances through the passages in the body, a surface of the valve member being cylindrical and having an axis of curvature colinear with the pivot axis of the valve member, the cylindrical surface fitting tightly against the surface of the body in which the outlets are located, and at least one through passage in the valve member extending between an inlet, located in the cylindrical surface, and a common outlet nozzle for both pasty substances, the valve member having one extreme position in which its cylindrical surface closes both outlets and another extreme position in which the outlets are open to a maximum extent to the common outlet nozzle, and the pivotal position of the valve member between the two extreme positions determining the degree of alignment of the inlet with at least one of the outlets, the non-aligned portion of that outlet being closed by the cylindrical surface, whereby the ratio of the open areas of the outlets, and hence the proportions of the two pasty substances reaching the common outlet nozzle, depends upon the pivotal position of the valve member with respect to the body.

2. A dispensing device as defined in claim 1 for use with a tube wherein the two different regions within the tube are located one above the other, the dispensing device including a pipe extending between the lower region and one of the passages in the body, and an opening in the body at the upper end of the upper region through which the other of the passages communicates with the upper region.

3. A dispensing device as defined in claim 1 wherein the valve member has a substantially cylindrical shape, and the through passage and common outlet nozzle are located radially within the valve member.

4. A dispensing device as defined in claim 1 wherein the body includes a housing accommodating the valve member, the housing having a cylindrical surface against which the cylindrical surface of the valve member fits snugly.

5. A dispensing device as defined in claim 1 wherein the two outlets in the body are arranged side-by-side along a line generally parallel to the pivot axis of the valve member, and including through passages in the valve member terminating at two inlets in the cylindrical surface of the valve member, the two inlets being arranged side-by-side along a line generally parallel to the pivot axis of the valve member.

6. A dispensing device as defined in claim 5 wherein the two inlets are aligned with the two outlets, respectively, when the valve member is in its extreme position wherein the outlets are open to their maximum extent to the common outlet nozzle, one of the outlets being larger than the other so that it remains in full communication with its respective inlet in pivotal positions of the valve member wherein the smaller outlet only partially communicates with its respective inlet and the other part of the smaller outlet is partially closed by the cylindrical surface of the valve member.

7. A dispensing device as defined in claim 1 wherein the two outlets in the body are arranged side-by-side in a plane perpendicular to the pivot axis of the valve member, and wherein there is only a single through passage in the valve member.

8. A dispensing device as defined in claim 7 wherein the inlet to the through passage is large enough to uncover both outlets simultaneously.

9. A dispensing device as defined in claim 1 wherein one of the outlets located in a surface of the body has a circular internal shape, and the other outlet has a triangular internal shape.

* * * * *